US007266321B2

(12) United States Patent
Ahn et al.

(10) Patent No.: US 7,266,321 B2
(45) Date of Patent: Sep. 4, 2007

(54) APPARATUS FOR SUPPLYING VOLTAGE TO DEVELOPING DEVICE

(75) Inventors: Byeong-hwa Ahn, Yongin (KR); Young-min Yoon, Yongin (KR); Seung-yoon Lee, Suwon (KR); Se-hyun Lyu, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/671,778

(22) Filed: Sep. 29, 2003

(65) Prior Publication Data

US 2005/0053391 A1 Mar. 10, 2005

(30) Foreign Application Priority Data

Sep. 30, 2002 (KR) ..... 10-2002-0059366
May 16, 2003 (KR) ..... 10-2003-0031350
Jun. 19, 2003 (KR) ..... 10-2003-0039845

(51) Int. Cl.
*G03G 15/00* (2006.01)

(52) U.S. Cl. ..... 399/90

(58) Field of Classification Search ..... 399/88, 399/90, 228, 50–55

See application file for complete search history.

(56) References Cited

U.S. PATENT DOCUMENTS 5,051,866 A * 9/1991 Osaka ..... 361/711
5,099,278 A * 3/1992 Sato ..... 399/75
5,627,722 A * 5/1997 Hirst ..... 361/170
5,634,175 A * 5/1997 Michlin et al. ..... 399/90
6,151,465 A * 11/2000 Toba et al. ..... 399/90
6,263,178 B1 * 7/2001 Takeyama et al. ..... 399/228
6,694,117 B2 * 2/2004 Wakamatsu et al. ..... 399/228
6,826,380 B2 * 11/2004 Karakama et al. ..... 399/111

(Continued)

FOREIGN PATENT DOCUMENTS

JP 61-204651 9/1986

(Continued)

OTHER PUBLICATIONS

Office Action issued Feb. 25, 2005 issued from Korean Intellectual Property Office.

(Continued)

*Primary Examiner*—Quana Grainger
(74) *Attorney, Agent, or Firm*—Staas & Halsey LLP

(57) ABSTRACT

A voltage supply device for developing devices of a color image forming apparatus has a printed circuit board (PCB) connected with a high voltage supply source, a plurality of fixed contact point terminals provided at one end of the respective color developing devices, and a plurality of voltage changeover units for selectively connecting the PCB and the fixed contact point terminals to selectively supply the voltage from the high voltage supply source to the respective color developing devices. With the voltage supply device, contact point changeover is enabled without having to move the developing device, by using a relay part of a relatively simple structure during the change of developing device. Accordingly, deterioration of printing quality due to shock from the contact with the developing device is avoided, and the reliability of high voltage contact point changeover is improved. Further, the number of high voltage wiring harness, which is required for supplying voltage from the high voltage supply source to the developing devices, can be reduced.

10 Claims, 10 Drawing Sheets

U.S. PATENT DOCUMENTS

2002/0064390 A1* 5/2002 Oguma et al. ..... 399/90

FOREIGN PATENT DOCUMENTS

| | | |
|---|---|---|
| JP | 02-248970 | 10/1990 |
| JP | 02-251871 | 10/1990 |
| JP | 04-021872 | 1/1992 |
| JP | 05-197254 | 8/1993 |
| JP | 5-197254 | 8/1993 |
| JP | 06-009076 | 1/1994 |
| JP | 09-278303 | 10/1997 |
| JP | 11-109729 | 4/1999 |
| JP | 11-204000 | 7/1999 |
| JP | 2001-060024 | 3/2001 |
| JP | 2001-338551 | 12/2001 |
| JP | 2001356553 A * | 12/2001 |

OTHER PUBLICATIONS

Office Action issued on Oct. 31, 2006 by the Japanese Patent Office in the corresponding Japanese Patent Application No. 2003-340923.

* cited by examiner

APPARATUS FOR SUPPLYING VOLTAGE TO DEVELOPING DEVICE

CROSS-REFERENCE TO RELATED APPLICATION

This application claims the benefit of Korean Patent Application No. 2002-59366, filed on Sep. 30, 2002, Korean Patent Application No. 2003-31350 filed on May 16, 2003, and Korean Patent Application No. 2003-39845 filed on Jun. 19, 2003 in the Korean Intellectual Property Office, the disclosure of which is incorporated herein by reference.

BACKGROUND OF THE INVENTION

1. Field of the Invention

The present invention relates to an electrophotographic color image forming apparatus such as color photocopier and a color printer, and more particularly to an apparatus for supplying a high level of voltage to a developing device for a color printing or copying.

2. Description of the Related Art

As shown in FIG. 1, an electrophotographic color image forming apparatus such as a color laser printer or a color photocopier is generally equipped with a photosensitive medium 11, usually in a drum type, which is continuously rotated in a certain direction by a photosensitive medium driving source (not shown).

Along the outer circumference of the photosensitive medium 11, there are provided in the direction of rotation by order of: a charging unit 12; a laser scanning unit (LSU) 20; four sliding developing devices 31, 32, 33, 34 respectively storing yellow, magenta, cyan and black developers; a transfer unit 60; a discharge lamp 87; and a cleaning discharge unit 80.

The charging unit 12 is a scorotron charger, which functions to evenly charge the photosensitive medium 11. The LSU 20 irradiates in an axial direction a laser beam of a linear form onto the photosensitive medium 11.

The respective developing devices 31, 32, 33, 34 is either a thickness restricting member or a blade 51, which restricts a thickness of developer layer accumulating on the components such as a developing roller 13, a developer receiving unit 16, a developer feeding roller 15 and a developing roller 13. The developing devices 31, 32, 33, 34 are rotated by a development driving source (not shown). The developer is fed to the developing roller 13 via the developer feeding roller 15 of the developer receiving unit 16 which is applied with a predetermined high voltage, and is controlled to under a predetermined thin layer on the developing roller 13 by the thickness restricting blade 51.

The developing devices 31, 32, 33, 34 are a sliding type developing device, and supported to reciprocate inside a developing device guiding member (not shown). The developing devices 31, 32, 33, 34 are moved toward the photosensitive medium 11, overcoming the spring 74, by the eccentric cams 35 36, 37, 38 which are respectively fixed to a rotation shaft 56. Rotation of the rotation shaft 56 is controlled by an electric clutch (not shown).

During developing process, a developing bias voltage is applied to the developing roller 13. In case of negative-positive inversion, the developing bias voltage has the same polarity as that of the charging voltage of the photosensitive medium 11.

The transfer unit 60 electrostatically transfers the color image from the photosensitive medium 11 onto a recording paper (P), and the cleaning discharging unit 80 removes any residual developer from the photosensitive medium 11.

Describing the operation of the image forming apparatus 10 in more detail, first, with a print command, the photosensitive medium 11 is rotated by the photosensitive medium driving source (not shown), and the surface of the photosensitive medium 11 is charged by the charging unit 12 evenly. When the charged area reaches a developing position (d) for a first color to be printed, for example, when the charged area reaches a developing position (d) for the yellow developing device 31, an electric clutch of the yellow developing device is turned on, and therefore, moved toward the photosensitive medium 11 by the eccentric cam 35 and set to developing state.

Next, the surface of the photosensitive medium 11 is exposed to the LSU 20, and thus having a yellow electrostatic latent image formed thereon. As a result, a successive yellow image is developed at the developing position (d) by the developing device 31, from the leading end to the rear end of the image.

After the completion of the yellow image formation, and after the rear end of the image passes the developing position (d), the eccentric cam 35 is rotated, and accordingly, the yellow developing device 31 is separated from the photosensitive medium 11.

Then as the leading end of the image reaches a formation position (e) of the second color image, for example, when the leading end of the image reaches the formation position (e) of the magenta developing device 32, the electric clutch of the magenta developing device 32 is turned on, and as a result, the magenta developing device 32 is set to the developing state by the eccentric cam 36.

At this time, the yellow image being formed on the photosensitive medium 11, is passed through the transfer unit 60, the discharge lamp 87 and the cleaning discharge unit 80, all of which being not in operation, and then positioned below the charging unit 12. In order not to blur the image passing therebetween, usually, the transfer unit 60 and the cleaning discharging unit 80 are spaced apart from each other except for when the both are in operation.

The photosensitive medium 11, now being formed with the second color image, i.e., the yellow image under the charging unit 12, is again charged by the charging unit 12 evenly. Then the image corresponding to the magenta color is overlappingly formed by the exposure to the LSU 20, and the magenta image is developed by the magenta developing device 32 at the magenta developing position (e). After the completion of the magenta image formation and when the rear end of the image is passed through the magenta image developing position (e), the eccentric cam 36 is rotated, and as a result, the magenta developing device 32 is separated from the photosensitive medium 11.

Next, when the rear end of the image reaches a developing position (f) for the third color image, for example, when the rear end of the image reaches a developing position (f) for the cyan developing device 33, the electric clutch of the cyan developing device 33 is turned on, and by the eccentric cam 37, the cyan developing device is set to a developing state.

The composite image of yellow and magenta images, which has passed through the transfer unit 60, the discharging lamp 87 and the cleaner discharging unit 80, is positioned under the charging unit 12 again, and the photosensitive medium 11 is charged by the charging unit 12 evenly. The yellow-magenta image is overlapped with the cyan image, by the LSU 20 (32-4), and developed at the cyan developing position (f) by the cyan developing device 33. When the cyan image is formed, the rear end of the image passes through the cyan developing position (f), and the eccentric cam 37 is rotated so that the cyan developing device 33 is separated from the photosensitive medium 11.

Next, the black image is overlapped and formed in the same way as described above, and as a result, the image formation is completed. When being completed, the color image on the photosensitive medium 11 is transferred onto the recording paper P which is conveyed from the recording paper feeding unit.

After the transfer, the photosensitive medium 11 is discharged by the discharging lamp 87, and by the rotatable brush 81 of the cleaner discharging unit 80, a residual developer on the surface of the photosensitive medium 11 is removed so that the photosensitive medium 11 is returned to the initial state. The recording paper P with the image formed thereon is conveyed to a recording paper fusing unit and thus image is firmly attached to the paper and discharged out.

As described above, in a conventional image forming apparatus 10, approximately four developing devices 31, 32, 33, 34 representing the respective colors are constructed such that the same are slid to contact the photosensitive medium 11 by a predetermined pressure, or be spaced apart from the photosensitive medium 11, by the operation of the eccentric cams 35, 36, 37, 38, respectively. During one rotation of the photosensitive medium 11, i.e., in development of one sheet of recording paper, the four color developing devices 31, 32, 33, 34 are contacted with the developing roller 13 respectively once, and therefore, the developing devices 31, 32, 33, 34 are contacted with the developing roller 13 four times in total. As shown in FIG. 2, voltage supply sliding contact terminals 13*a*, 15*a*, 51*a*, which are connected with the developing roller 13, the developer feeding roller 15 and the developer layer thickness restricting blade 51, are sequentially connected with, or disconnected from fixed contact point terminals 90*a*', 90*b*', 90*c*'. The fixed contact point terminals 90*a*', 90*b*', 90*c*' are connected with corresponding voltage units of the high voltage power supply (HVPS) 90, i.e., a developing roller voltage supply (supply, 90*a*), a developer feeding roller voltage supply (Deve, 90*b*), and a developer layer thickness restricting blade voltage supply (Blade, 90*c*) through a wiring harness.

However, the conventional image forming apparatus 10 has a problem of complex construction due to requirement for the eccentric cams 35, 36, 37, 38, cam driving motor (not shown) and the electric clutch for the changing of the developing device among the four developing devices 31, 32, 33, 34.

Further, in every changing of the developing device, the impact of the contact between the photosensitive medium 11 and the developing roller 13 of each developing device 31, 32, 33, 34 is directly transmitted to the photosensitive medium 11, and as a result, the lifetime of the photosensitive medium 11 is shortened. Additionally, the impact from the contact also causes change of running speed of the photosensitive medium 11, which subsequently causes a degradation of printing quality such as a 'jitter'.

Further, because of the complex structure in which the voltage supply device for the developing devices 31, 32, 33, 34 are connected with the voltage units 90*a*, 90*b*, 90*c* and the fixed contact point terminals 90*a*', 90*b*', 90*c*' of the high voltage supply 90 through a rather complex wiring harness, fabricating is complicated. Also, due to sliding contact between the sliding contact point terminals 13*a*, 15*a*, 51*a* and the fixed contact point terminals 90*a*', 90*b*', 90*c*', reliability of high voltage contact point changeover is deteriorated.

SUMMARY OF THE INVENTION

The present invention has been developed in order to solve the above, and other, problems in the prior art. Accordingly, one aspect of the present invention is to provide a voltage supply of a developing device, which prevents deterioration of printing quality and reduction of lifetime of a photosensitive medium due to an impact from the contact between the photosensitive medium and the developing device a developing device change, and is also capable of contact point changeover, with the developing device being secured in place instead of being moved, by using a voltage changeover unit of a relatively simple structure, and therefore, enhancing the reliability of the high voltage contact point changeover.

Also, another aspect of the present invention is to provide a high voltage supply device for a developing device of a color image forming apparatus capable of preventing deformation of a contacting member and performing a stable high voltage supply even during a long operation of a high voltage changeover device.

Yet, another aspect of the present invention is to provide a high voltage supply device for a developing device of a color image forming apparatus having a voltage changeover device which requires a less number of high voltage wiring harness.

In order to achieve the above aspects and/or other features of the present invention, developing devices are secured in an image forming apparatus, and voltage to the respective parts of the developing devices is selectively supplied through the selective connection between a high voltage supply source and an input terminal of the developing devices.

According to one aspect of the present invention, a voltage supply device for developing devices of a color image forming apparatus is provided, which includes a printed circuit board (PCB) connected with a high voltage supply source, a plurality of fixed contact point terminals provided at one end of the respective color developing devices, and a plurality of voltage changeover units for selectively connecting the PCB and the fixed contact point terminals to selectively supply the voltage from the high voltage supply source to the respective color developing devices.

A terminal connecting part, which may be formed as a spring terminal of a predetermined flexibility, is additionally provided between the PCB output terminal and the fixed contact point terminals, and the terminal connecting part supplies a power to a plurality of different elements of the developing devices. According to one aspect of the present invention, contact between the PCB output terminals and the fixed contact point terminals is improved, and the reliability of voltage application to the respective parts of the developing devices, for example, to the developing roller and the developer feeding roller, is improved.

The high voltage supply source is formed as a single voltage supply which has a developing roller voltage unit, a developer feed roller voltage unit and a developer layer thickness restricting blade voltage unit.

A PCB input terminal and a PCB output terminal are additionally provided to one side of the PCB, and the respective voltage changeover units apply high voltage to the respective color developing devices by selectively connecting the PCB output terminal and the PCB input terminal. Accordingly, reliability of voltage application is guaranteed, and printing quality is improved.

According to the second aspect of the present invention, a voltage supply device for developing devices of a color image forming apparatus is provided. The voltage supply device includes a printed circuit board (PCB) connected with a high voltage supply source, a plurality of PCB input terminals and a plurality of PCB output terminals provided at the PCB, a plurality of fixed contact point terminals provided to one end of the color developing devices, a plurality of terminal connecting parts connecting the PCB output terminals and the fixed contact point terminals, and a plurality of voltage changeover units comprised of a relay part which selectively applies voltage to the PCB output terminals to selectively supply the voltage from the high voltage supply source to the respective color developing devices.

The relay part includes a supporting member provided at the PCB, an electromagnet fixed to the supporting member and magnetized by an electric current, an armature pivotally movable so as to pivot with respect to the supporting member to contact with or spaced apart from the electromagnet according to a magnetic force of the electromagnet during the operation of the electromagnet, and at least a pair of relay input terminal and relay output terminal arranged on a voltage supply path of the PCB, in an opposite position with each other at a predetermined distance, the relay input terminal and the relay output terminal being contacted with, or spaced apart from each other according to contact and non-contact of the armature with the electromagnet so as to switch the power supply accordingly.

The armature is formed as a metal plate member in letter 'L' shape, which comprises a first end for being contacted with, or spaced apart from the electromagnet by the magnetic force of the electromagnet during the operation of the electromagnet, and a second end for contacting the relay input terminal with the relay output terminal when the first end contacts with the electromagnet.

Optionally, the armature may additional include an extendibly-moving member which is arranged between one among the relay input terminal and the relay output terminal on the one hand, and the second end of the armature on the other hand, to move with respect to the supporting member and assist the second end to connect the relay input terminal and the relay output terminal when the first end contacts with the electromagnet. The extendibly-moving member includes a non-conductive plate member in the shape of letter 'T' which is secured with a lower end to one among the relay input terminal and the relay output terminal through a receiving hole defined in the supporting member.

The relay input terminal and the relay output terminal each includes a plate spring having a conductivity and is secured to the PCB through the supporting member, and a contact point formed at an end of the plate spring.

The terminal connecting part, which connects the output terminal of the PCB with the input terminal of the developing devices, is formed as a spring to absorb shock. Preferably, at least one of the terminal connecting parts, which corresponds to the developing devices, supply power to a plurality of different elements of the developing devices.

According to another aspect of the present invention, a voltage supply device for developing devices of a color image forming apparatus is provided, which includes a printed circuit board (PCB) connected with a high voltage supply source, a plurality of PCB input terminals and a plurality of PCB output terminals provided at the PCB, a plurality of fixed contact point terminals provided to one end of the color developing devices, a plurality of terminal connecting parts connecting the PCB output terminals and the fixed contact point terminals, and a plurality of voltage changeover units comprised of a solenoid part which selectively applies voltage to the PCB output terminals to selectively supply the voltage from the high voltage supply source to the respective color developing devices.

The voltage changeover unit includes a holder, a contacting member having one side connected to the holder and the other side fixed to the PCB output terminals, and a holder-moving unit for moving the holder toward and away from the PCB. An upper portion of the contacting member being connected with the holder is formed into a hook-shaped ring, and a lower portion is fixed to the PCB.

The contacting member is a plate spring to absorb shock.

According to yet another aspect of the present invention, an image forming apparatus is provided. The image forming apparatus includes a photosensitive medium, a plurality of color developing devices fixed a constant distance from the photosensitive medium and developing an electrostatic latent image on the photosensitive medium with respective color developers, a printed circuit board (PCB) connected to a high voltage supply source, a plurality of PCB input terminals and PCB output terminals provided at the PCB, a plurality of fixed contact point terminals provided at an end of the respective color developing devices, and a voltage connecting unit for selectively applying voltage to the PCB output terminals to selectively supply the voltage from the high voltage supply source to the respective color developing devices.

With the voltage supply device according to the present invention, contact point changeover is enabled without having to move the developing device, i.e., by using a relay part of a relatively simple structure during the change of developing device. Accordingly, deterioration of printing quality due to shock from the contact with the developing device is avoided, and the reliability of high voltage contact point changeover is improved. Further, the number of high voltage wiring harness, which is required for supplying voltage from the high voltage supply source to the developing devices, can be reduced.

According to the present invention, rotation speed variation and load variation of the photosensitive medium do not occur during the developing process, and therefore, a stable image quality is obtained.

Also, according to the present invention, since parts such as a motor and a cam, which are conventionally required for driving the developing devices, are not required, the present invention can utilize a voltage supply unit with a simplified structure. Also, since a variation does not occur in the developing gap between the developing devices and the photosensitive medium, poor development can be prevented.

Also, according to the present invention, because the high voltage changeover device for the respective color developing devices of the image forming apparatus directly contacts with the respective developing devices using the solenoid or the relay, it can minimize a high voltage supplying interval between the high voltage circuit board and the respective developing devices. Also, a contacting point can be minimized through a direct contact. This direct contacting guarantees a stable high voltage supply to the respective color developing devices, and ultimately, a substantially perfect color image can be realized.

Additional aspects and advantages of the invention will be set forth in part in the description which follows and, in part, will be obvious from the description, or may be learned by practice of the invention.

BRIEF DESCRIPTION OF THE DRAWINGS

These features, and/or other aspects and advantages of the invention will become apparent and more readily appreciated from the following description of the embodiments taken in conjunction with the accompanying drawings, in which.

DETAILED DESCRIPTION OF THE EMBODIMENTS

Figure 1:
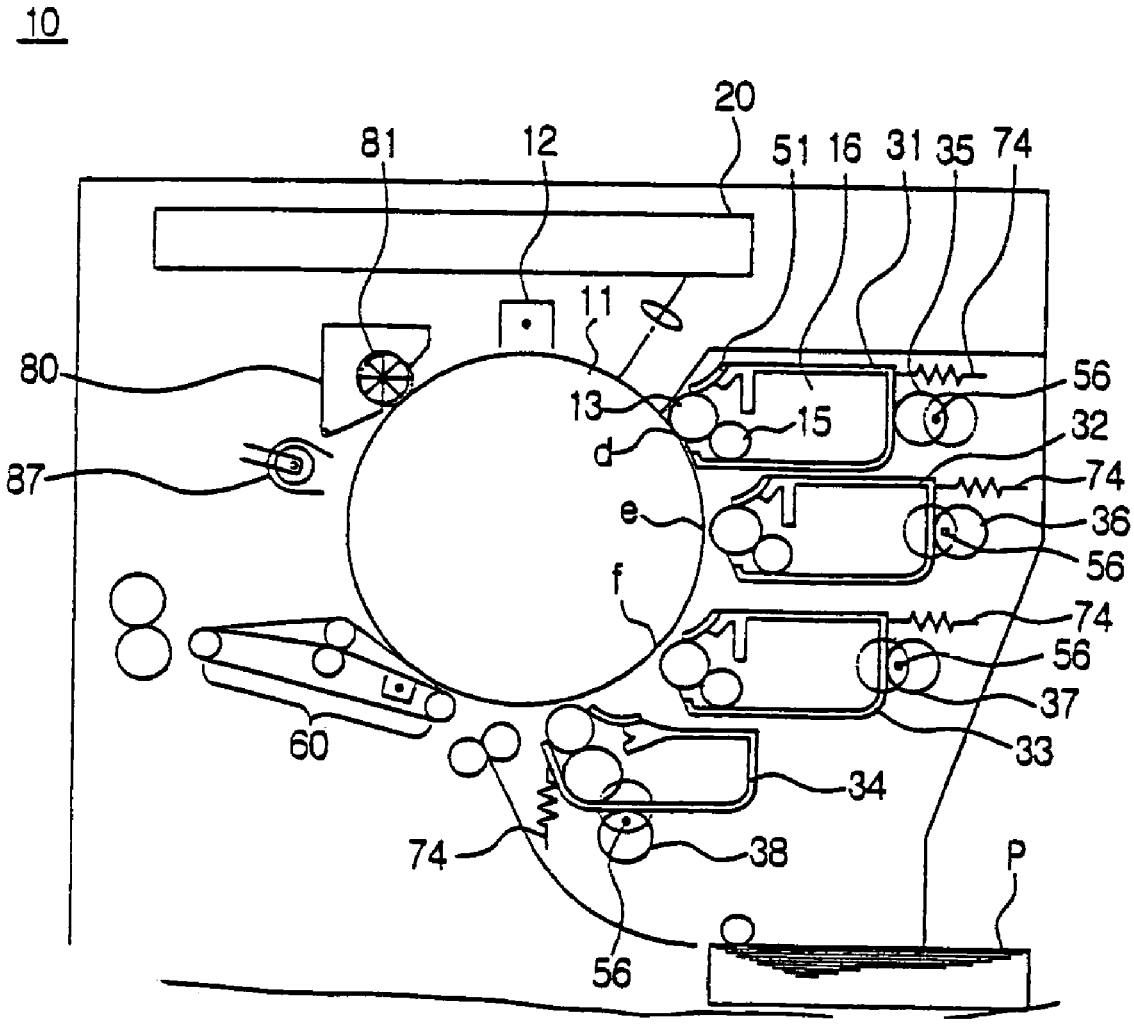
FIG.1 (PRIOR ART)
FIG. 1 is a schematic view of a conventional color image forming apparatus.
Figure 2:
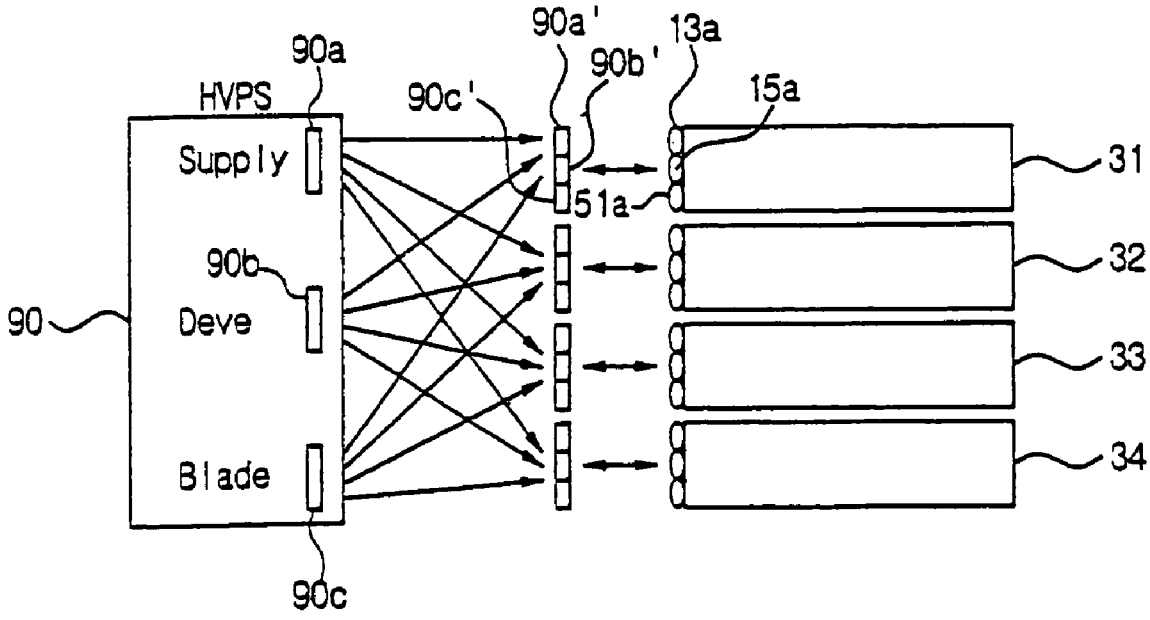
FIG.2 (PRIOR ART)
FIG. 2 is a schematic view of a voltage supply device for a developing device of the color image forming apparatus of FIG. 1.

Reference will now be made in detail to the embodiments of the present invention, examples of which are illustrated in the accompanying drawings, wherein like reference numerals refer to the like elements throughout. The embodiments are described below in order to explain the present invention by referring to the figures.

In the first aspect of the present invention, the voltage changeover unit is formed of a relay part, and in the second aspect of the present invention, the voltage changeover unit is formed of a solenoid part.

Figure 3:
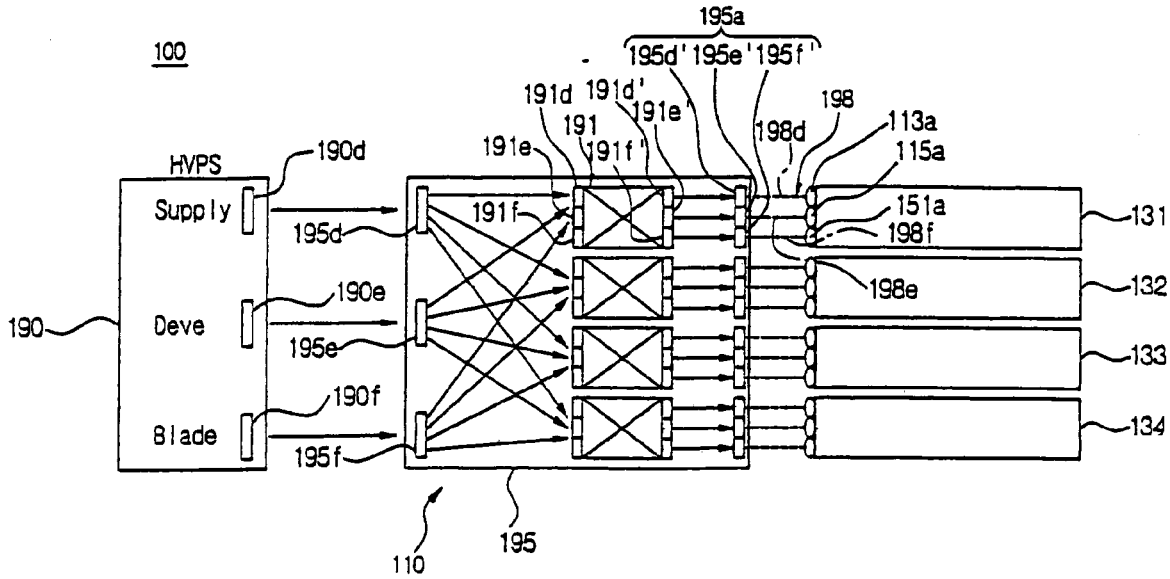
FIG. 3 is a schematic view of a voltage supply device for a developing device according to one aspect of the present invention.
Figure 4:
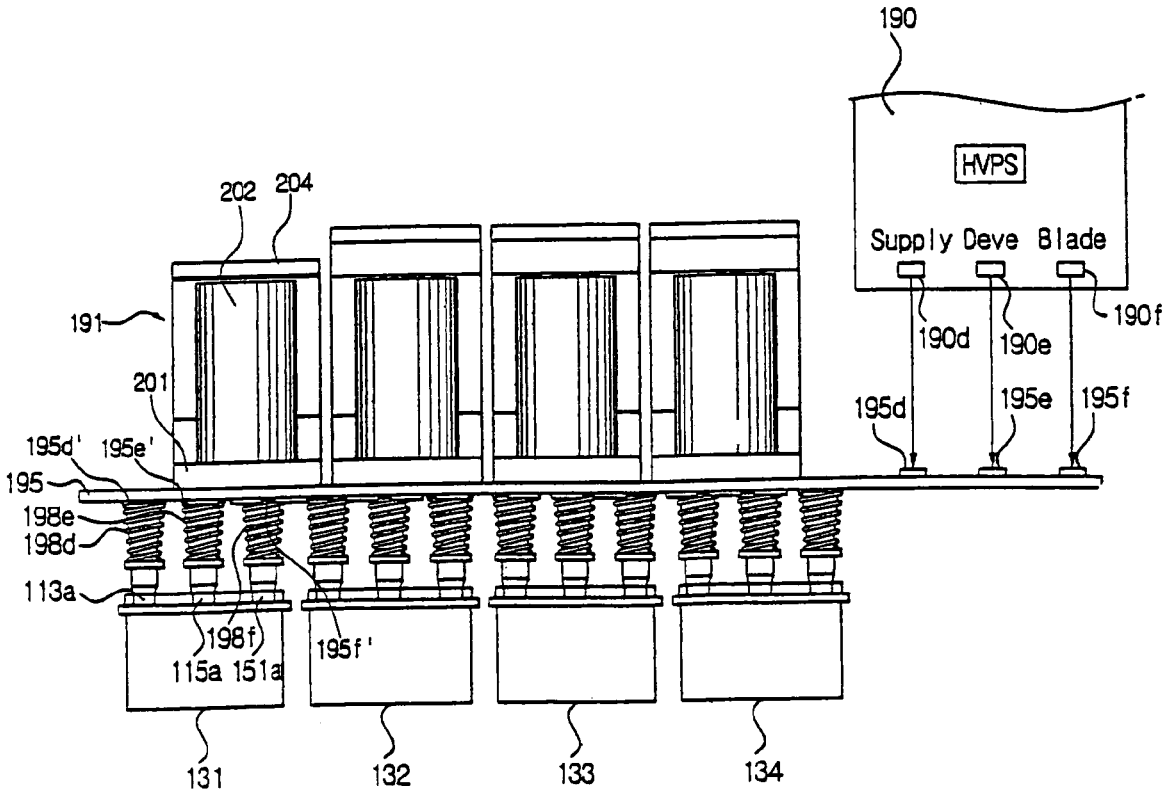
FIG. 4 is a plan view illustrating connection among a high voltage supply, a voltage changeover unit and respective developing devices of the voltage supply device of FIG. 3.

FIGS. 3 and 4 schematically show a voltage supply device 100 for a developing device according to one aspect of the present invention.

In the color image forming apparatus having the voltage supply device 100 according to one aspect of the present invention, a photosensitive medium (not shown) and developing devices are provided. The photosensitive medium is in a cylindrical form and for forming an electrostatic latent image thereon due to an electric potential property of the surface thereof. The developing devices i.e. a yellow developing device, a magenta developing device, a cyan developing device, and a black developing device are secured in place at a predetermined gap with a photosensitive medium. The predetermined gap is usually maintained at an example 0.2 mm, but it is not limited to such.

In order to supply high voltage to the respective developing devices 131, 132, 133, 134, the voltage supply device 100 includes a high voltage supply 190 for generating high voltage, a printed circuit board (PCB) 195, a fixed contact point terminal formed at a side of the developing device, and a voltage changeover unit or a relay unit 191 according to the first aspect of the present invention, arranged between the developing devices 131, 132, 133, 134 and the high voltage supply 190 to sequentially supply the voltage from the high voltage supply 190 to the respective developing devices 131, 132, 133, 134.

The high voltage supply 190 includes a developing roller voltage unit 190*d* to supply necessary voltage to a developing roller (not shown), a developer feeding roller voltage unit 190*e* to supply necessary voltage to a developer feeding roller (not shown), and a developer layer thickness restricting blade voltage unit 190*f* to supply necessary voltage to a developer layer thickness restricting blade (not shown).

The PCB 195 includes first to third PCB input terminals 195*d*, 195*e*, 195*f* which are connected with the developing roller voltage unit 190*d*, the developer feeding roller voltage unit 190*e* and the developer layer thickness restricting blade voltage unit 190*f* through wiring harness, and four PCB output terminals 195*a* which are connected with the fixed contact point terminals 113*a*, 115*a*, 151*a* of the developing devices 131, 132, 133, 134 connected with the developing roller, the developer feeding roller and the developer layer thickness restricting blade through a terminal connecting portion 198. The PCB output terminals 195*a* are formed of first to third contact points 195*d*', 195*e*', 195*f*'.

The terminal connecting portion 195, connecting the PCB 195 and the developing devices 131, 132, 133, 134, are formed of first to third spring terminals 198*d*, 198*e*, 198*f* to absorb impact from the developing devices 131, 132, 133, 134 such as vibrations.

Figure 5:
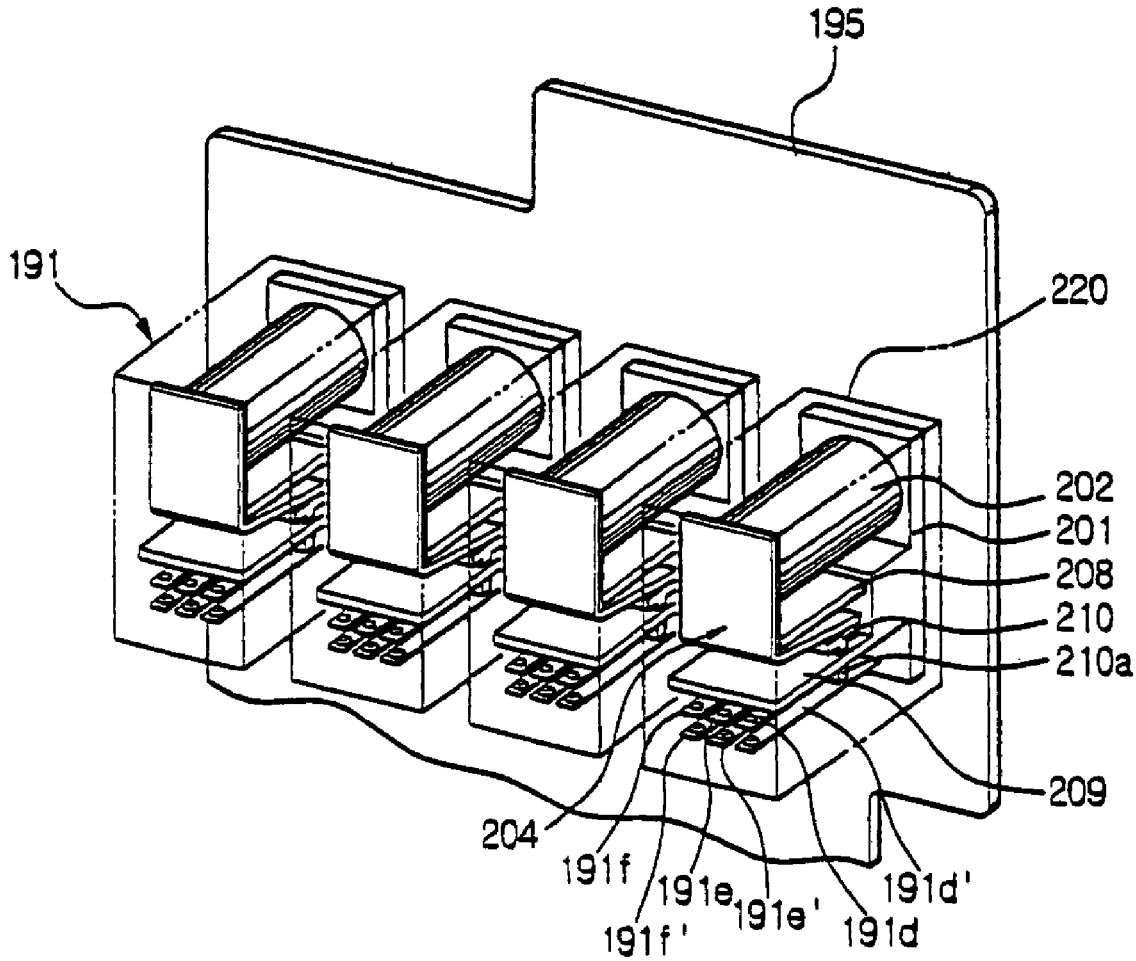
FIG. 5 is a perspective view of a relay of a voltage changeover unit of the voltage supply device of FIG. 3.
Figure 6A:
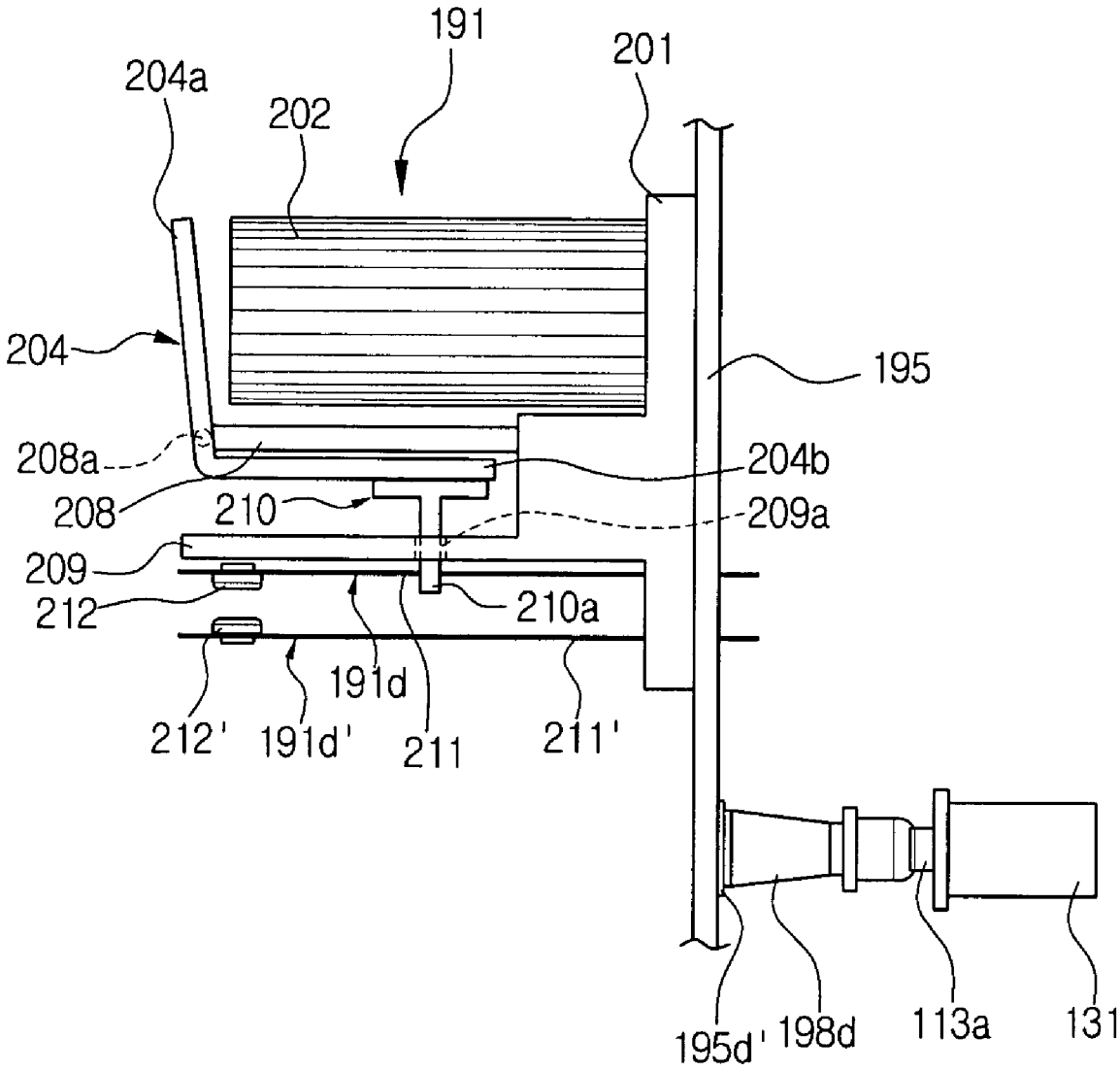
FIGS. 6A and 6B are side views illustrating the operation of the relay of the voltage changeover unit of the voltage supply device of FIG. 3.
Figure 6B:
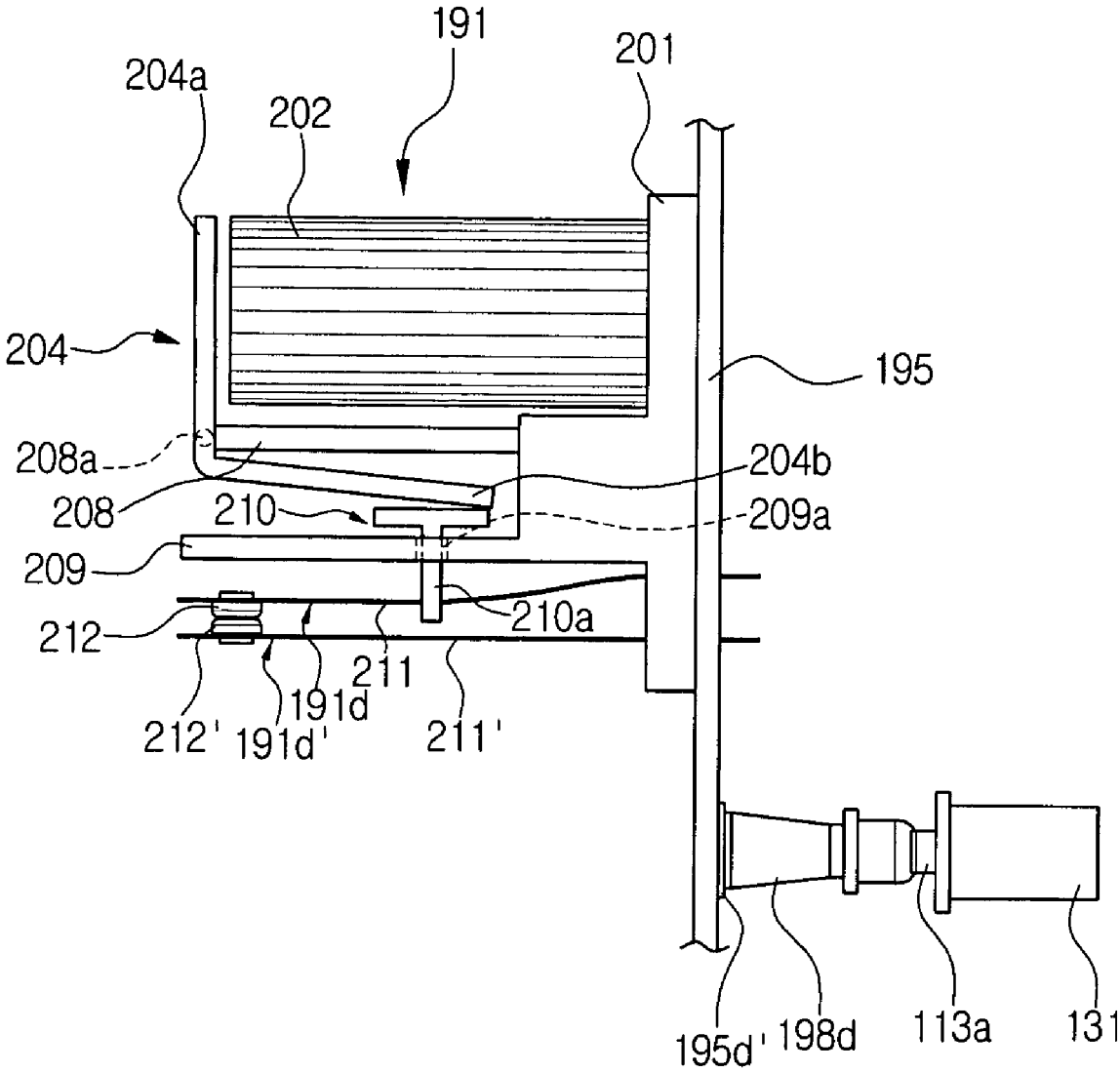

The voltage changeover unit is, as mentioned above, formed of the relay part 191, and as shown in FIGS. 5, 6A and 6B, each relay part 191 includes a supporting member 201 fixed to the PCB 195, an electromagnet 202 fixed to the supporting member 201 and magnified by the electric current, an armature 204 pivotally supported on a hinge axis 208*a* of an armature supporting portion 208 of the supporting member 201 to connect with, or disconnect from, the electromagnet 202 according to the magnetic force of the electromagnet 202, three pairs of relay input and output terminals 191*d*, 191*d*', 191*e*, 191*e*', 191*f*, 191*f*' arranged opposite to each other and along the connecting line between the first to third PCB input terminals 195*d*, 195*e*, 195*f* which are patterned on the PCB 195 and the contact points 195*d*', 195*e*', 195*f*' of the PCB output terminal 195*a*, to connect with, or disconnect from each other according to the connecting or disconnecting of the armature 204 to the electromagnet 20, and a cover 220 (FIG. 5) to seal the above parts.

The armature 204 is preferably a metal plate member formed in the shape of letter 'L', having a first end 204*a* for connecting and disconnecting with the electromagnet 202 according to the magnetic force of the electromagnet 202 in operation, and a second end 204*b* for connecting the relay input and output terminals 191*d*, 191*d*', 191*e*, 191*e*', 191*f*, 191*f*' when the first end 204*a* is connected with the electromagnet 202.

In order to ensure that the second end 204*b* easily connects the relay input and output terminals 191*d*, 191*d*', 191*e*,

191*e*', 191*f*, 191*f*' during the contacting of the first end 204*a* with the electromagnet 202, the armature 204 additionally includes an extendibly-moving member 210 between the relay input terminals 191*d*, 191*e*, 191*f* at the upper portion and the second end 204*b*. The extendibly-moving member 210 is movable through a receiving hole 209*a* which is formed in an extendibly-moving member supporting portion 209 of the supporting member 201.

The extendibly-moving member 210 is preferably a plate member in letter 'T' shape, having its lower end 210*a* fixed to a plate spring 211 of the relay input terminals 191*d*, 191*e*, 191*f* through the receiving hole 209*a* of the extendibly-moving member supporting portion 209. The plate member is a nonconductive material for the insulation effect between the plate spring 211 of the relay input terminals 191*d*, 191*e*, 191*f* and the armature 204.

The relay input and output terminals 191*d*, 191*d*', 191*e*, 191*e*', 191*f*, 191*f*' are each formed of a conductive long plate spring 211 or 211', and a contact point 212 or 212' formed at an end of the plate spring 211 or 211'.

While the relay input terminals 191*d*, 191*e*, 191*f* are connected through a connecting line patterned in the PCB 195 to the PCB input terminals 195*d*, 195*e*, 195*f*, which are connected to the voltage units 190*d*, 190*e*, 190*f* of the high voltage supply 190 through wiring harness, the relay output terminals 191*d*', 191*e*', 191*f*' are connected through a connecting line patterned in the PCB 195 to the first to third contact points 195*d*', 195*e*', 195*f*' of the PCB output terminal 195*a* which are connected to the fixed contact point terminals 113*a*, 115*a*, 151*a* of the respective developing devices by first to third spring terminals 198*d*, 198*e*, 198*f*.

While the power is supplied from the high voltage supply 190 and split into three different voltages to be supplied to the developing rollers, the developer feeding rollers and the developer layer thickness restricting blades of the respective developing devices 131, 132, 133 through the PCB output terminal 195*a* which has three voltage units 190*d*, 190*e*, 190*f*, three PCB input terminals 195*d*, 195*e*, 195*f*, three pairs of relay input and output terminals 191*d*, 191*d*', 191*e*, 191*e*, 191*f*, 191*f*', and three contact points 195*d*', 195*e*', 195*f*', this is just one way of example, and thus should not be considered as limiting. For example, if designed differently, a reference voltage may be supplied from the high voltage supply 190 to the respective developing devices 131, 132, 133, 134 through the PCB output terminal which has one voltage unit, one PCB input terminal, a pair of relay input and output terminals and one contact point, and a separate voltage splitter provided to the developing devices 131, 132, 133, 134 splits the reference voltage to three voltages for the developing roller, the developer feeding roller and the developer layer thickness restricting blade, respectively.

With the voltage supply device 100 according to the first aspect of the present invention, instead of being connected with, or disconnected from the photosensitive medium, the developing devices 131, 132, 133, 134 are operated at a predetermined fixed gap to the photosensitive medium. Accordingly, problems of printing quality deterioration and reduction of photosensitive lifetime due to contact between the developing devices 131, 132, 133, 134 and the photosensitive medium do not occur. Further, as the voltage supply device 100 uses the PCB 195 together with the voltage changeover unit having a relay part 191 which is simple in structure, high voltage region usually requiring complex wiring harness can be simplified, and the reliability of changeover at the high voltage contacts is enhanced.

The voltage supply device for a developing device constructed as above according to the first aspect of the present invention will be described in greater detail with reference to FIGS. 3 to 6B.

First, with the input of print command, an electrostatic latent image is formed on the photosensitive medium. When the photosensitive medium bearing the first color image such as a yellow electrostatic latent image is moved to a corresponding developing position, i.e., to the developing position of the yellow developing device 131 by a photosensitive medium driving source (not shown), the developer feeding roller of the yellow developing device 131 and the developing roller rotate in opposite directions to feed the developer onto the photosensitive medium.

At this time, in order to apply predetermined voltages to the developing roller, the developer feeding roller and the developer layer thickness restricting blade of the yellow developing device 131, the voltage supply device 100 switches on the electromagnet of the relay part which switches the relay input terminals 191*d*, 191*e*, 191*f* and the relay output terminals 191*d*', 191*e*', 191*f*' which are connected through the first to third contact points 195*d*', 195*e*', 195*f*' of the PCB output terminal 195*a*. For example, the voltage supply device 100 switches on the electromagnet 202 of the yellow relay part 191.

According to the switching 'on' of the electromagnet 202 of the yellow relay part 191, as shown in FIG. 6B, the first end 204*a* of the armature 204 is drawn toward the electromagnet 202 by the magnetic force of the electromagnet 202, causing the second end 204*b* to pivot about the hinge axis 208*a* in a clockwise direction so as to push the extendibly-moving member 210 downward.

As a result, the lower end 210*a* of the extendibly-moving member 210, which secures the plate spring 211 of the relay input terminal 191*d*, 191*e*, 191*f*, is moved downward by the second end 204*b* of the armature 204 through the receiving hole 209*a* defined in the extendibly moving member supporting portion 209 of the supporting member 201, pushing the plate spring 211 of the relay input terminal 191*d*, 191*e*, 191*f*. Accordingly, the contact point 212 of the relay input terminal 191*d*, 191*e*, 191*f* is contacted with the contact point 212' of the relay output terminal 191*d*', 191*e*', 191*f*'.

When the contact point 212 of the relay input terminal 191*d*, 191*e*, 191*f* contacts with the contact point 212' of the relay output terminal 191*d*', 191*e*', 191*f*', the voltage from the developing roller voltage unit 190*d*, the developer feeding roller voltage unit 190*e* and the developer layer thickness restricting blade voltage unit 190*f* of the high voltage supply source 190, is fed to the fixed contact terminals 113*a*, 115*a*, 151*a* of the yellow developing device 131 through the first to third contact points 195*d*', 195*e*', 195*f*' of the PCB output terminal 195*a* which is connected with corresponding relay output terminal 191*d*', 191*e*', 191*f*' through the connecting line patterned in the PCB 95.

As a result, when the developer is fed to the developing roller by the developer feeding roller, the developer is jumped onto the surface of the developing roller due to different electric potential between the developer feeding roller and the developing roller. In other words, the developer is transferred onto the surface of the developing roller which has lower electric potential than the developer feeding roller. Once the developer is jumped onto the surface of the developing roller, the thickness of the developer is adjusted by the developer layer thickness restricting blade, which provides a predetermined electric charge to the developer through friction charge.

After that, the developer in the gap approximately of 0.2 mm between the photosensitive medium and the developer roller, is moved onto the electrostatic latent image on the photosensitive medium by the electric field which is generated due to the difference in electric potential between the electrostatic latent image of the photosensitive medium and the developing roller. Accordingly, the electrostatic latent image is visualized by the developer.

After the completion of yellow image formation as described above, the voltage supply device 100 according to the present invention switches 'off' the electromagnet 202 of the yellow relay part 191 which is connected with the fixed contact point terminals 113*a*, 115*a*, 151*a* of the yellow developing device 131, so as to block the voltage from being supplied to the developing roller, the developer feeding roller and the developer layer thickness restricting blade of the yellow developing device 131.

With the switching 'off' of the electromagnet 202 of the yellow relay part 191, as shown in FIG. 6A, the electromagnet 202 loses magnetic force, and as a result, the contact point 212 of the relay input terminal 191*d*, 191*e*, 191*f* is disconnected from the contact point 212' of the relay output terminal 191*d*', 191*e*', 191*f*' by the recovering force of the plate spring 211.

At this time, as the second end 204*b* is pushed upward by the extendibly-moving member 210 which is lifted upward by the recovering force of the plate spring 211, the first end 204*a* of the armature 204 is pivoted about the hinge axis 208*a* in the counterclock wise direction to be spaced apart from the electromagnet 202.

As a result, the voltage, which is supplied from the developer roller voltage unit 190*d*, the developer feeding roller voltage unit 190*e* and the developer layer thickness restricting blade voltage unit 190*f* of the high voltage supply source 190 to the relay input terminals 190*d*, 190*e*, 191*f* of the yellow relay part 191, is blocked from being supplied to the first to third contact points 195*d*', 195*e*', 195*f*' and the first to third spring terminals 198*d*, 198*e*, 198*f* of the PCB output terminal 195*a*, and the fixed contact point terminals 113*a*, 115*a*, 151*a* of the yellow developing device through the corresponding relay output terminals 191*d*', 191*e*', 191*f*'.

After that, as the rear end of the image is passed the developing position and when the leading end of the image reaches the second color image, for example, when it reaches the developing position of the magenta developing device 132, the voltage supply device 100 operates in the way as described above to supply voltage to the developing device 132. As a result, the magenta developing device 132 forms an image.

At this time, the yellow image on the photosensitive medium is passed through the components such as the transfer unit (not shown), the discharging lamp (not shown) and the cleaner discharging unit (not shown) to be positioned below the charging unit (not shown). Accordingly, the photosensitive medium with the yellow image is again charged by the charging unit evenly, and then after the image corresponding to the magenta color is overlapped on the yellow image and exposed to the LSU (not shown), the image is developed at the magenta developing position by the magenta developing device 132.

When the other color images such as cyan and black images are formed and overlapped on one another by the way described above, the formation of image is completed.

Accordingly, the color image on the photosensitive medium is transferred by the transfer unit (not shown) onto a recording paper which is conveyed from the recording paper feeding unit, and at the same time, the residual developer on the surface of the photosensitive medium is removed by the rotatable brush of the cleaner discharging unit (not shown) to an initial state. The recording medium with the completed image formed thereon, is conveyed to the recording paper fusing unit (not shown) for fusing, and then discharged out.

Figure 7:
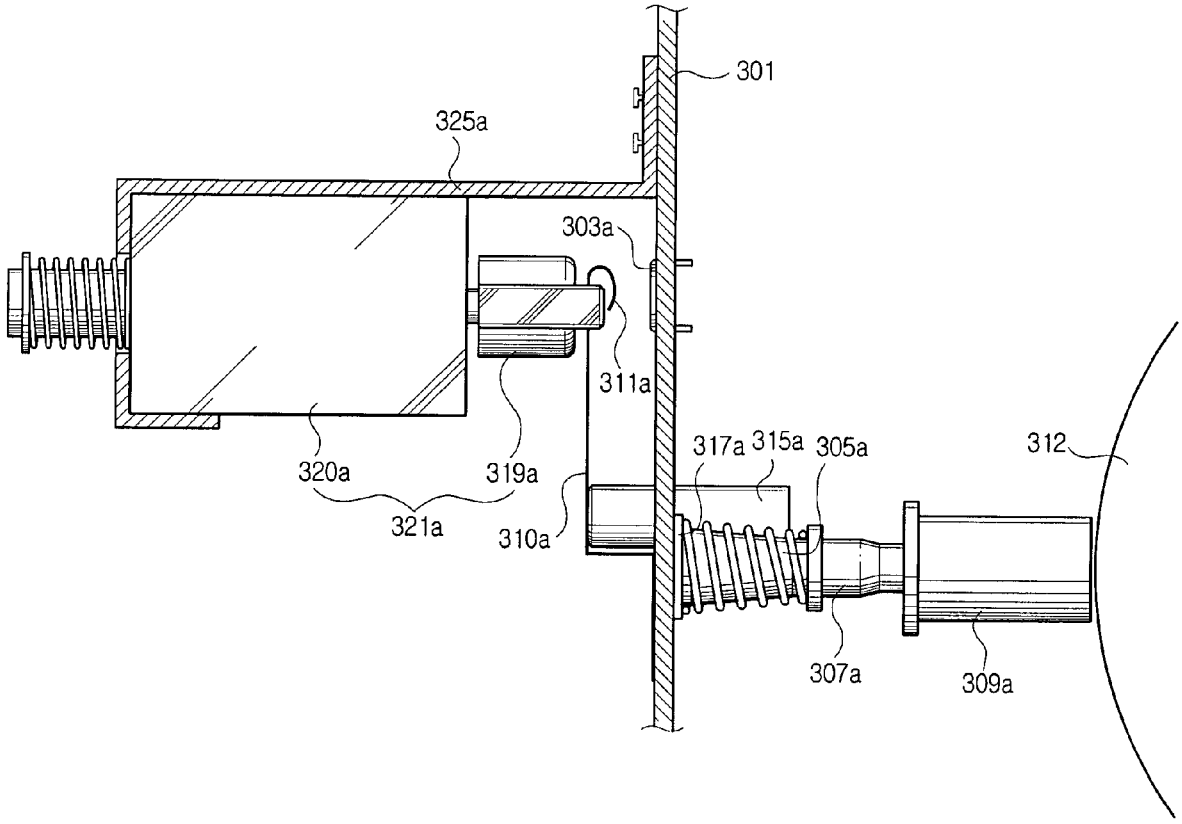
FIG. 7 is a view of a voltage supply device for a developing device according to a second aspect of the present invention, illustrating one among the voltage changeover units for the respective color images before the application of power.
Figure 8:
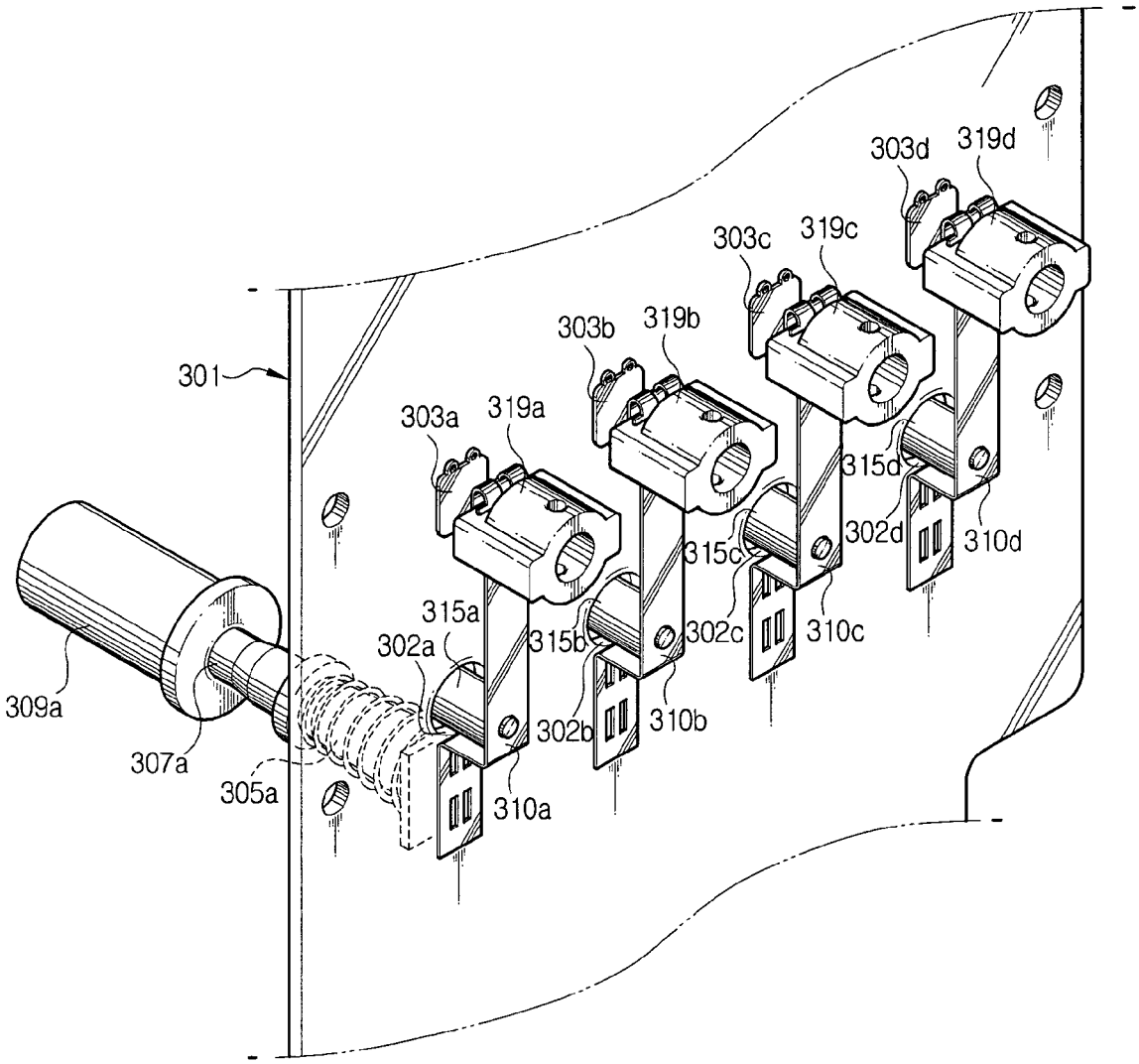
FIG. 8 is a perspective view of the voltage supply device for the developing device according to the second aspect of the present invention, illustrating the voltage changeover units for the respective color images with the solenoid not shown for clearer illustration of voltage changeover unit.
Figure 9:
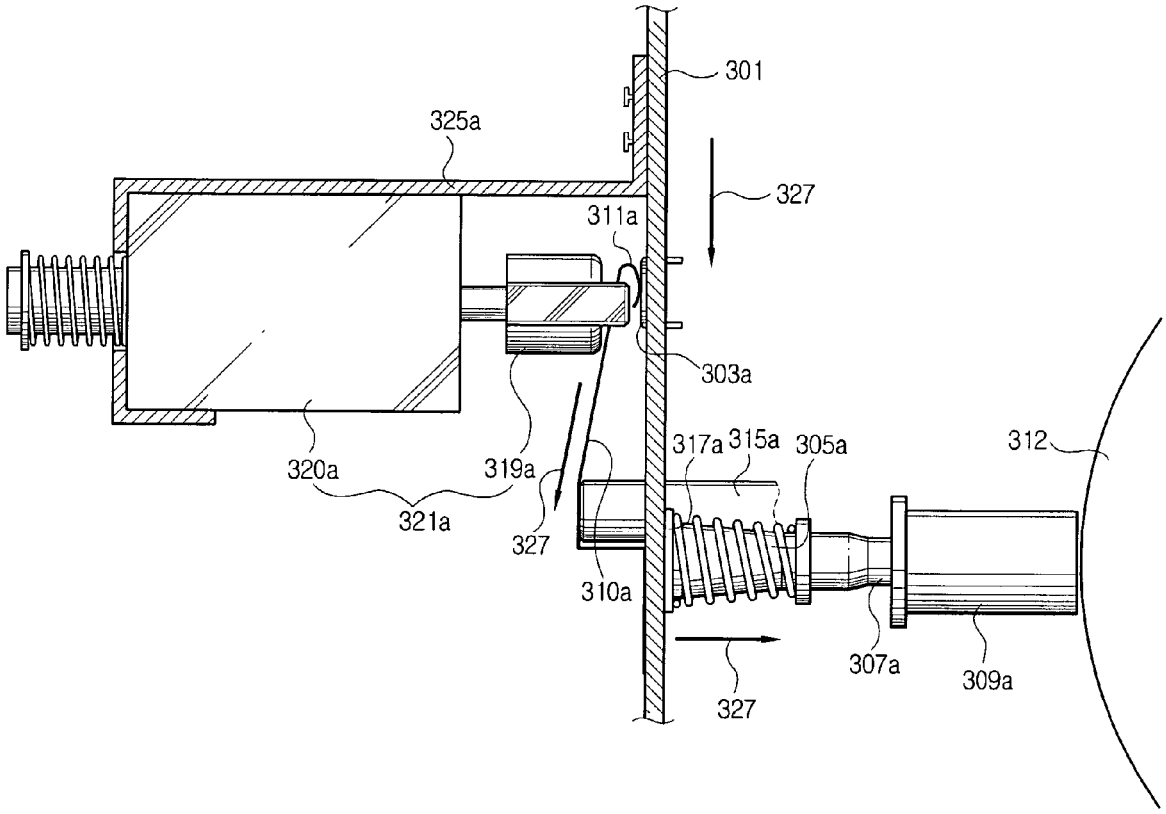
FIG. 9 is a side view illustrating the voltage changeover unit after the application of high voltage, for the explaining of the operation of the voltage changeover unit of FIG. 7.

With reference to FIGS. 7 to 9, the second aspect of the present invention will be described below. Throughout the description, the similar or identical parts which have already been described in the first aspect of the present invention will be omitted for the convenience in explanation.

FIG. 7 is a view for illustrating the second aspect of the present invention, in which a high voltage changeover unit of a yellow developing device is representatively shown among the plurality of voltage changeover units for a simple illustration, and FIG. 8 is a perspective view illustrating the voltage changeover units for the respective color images with the solenoid not shown for clearer illustration of voltage changeover unit.

Although the voltage supply device is depicted as comprising a high voltage supply source 190 (FIG. 3) to generate high voltage, a printed circuit board (PCB 301), and a fixed contact point terminal provided to an end of the developing device, to supply high voltage to the respective developing devices, the voltage supply device according to the second aspect of the present invention also includes a voltage changeover unit arranged between the developing device and the high voltage supply source 190 to sequentially supply the voltage from the high voltage supply source 190 to the respective developing devices. In this aspect of the present invention, the voltage changeover unit is formed as a solenoid.

Herein, the description will be made about a high voltage changeover device for a yellow developing device 309*a*. The other color developing devices have a similar structure as that of the yellow developing device 309*a*. That is, at a rear end of the yellow developing device 309*a* as shown in FIG. 7 is disposed a fixed contact point terminal 307*a*, and such a fixed contact point terminal 307*a* is disposed at each rear end of the other color developing devices in a similar manner.

As shown in FIG. 7, the yellow developing device 307*a* is at a predetermined developing gap with the photosensitive drum 312 and the PCB 301 is disposed at a rear portion of the developing device 309*a*. A PCB output terminal 317*a* is formed at a lower end of one side of the PCB 301, while there is a PCB input terminal 303*a* fixed to the upper portion of the opposite side.

The PCB input terminal 303*a* is connected to the high voltage circuit (not shown) built in the PCB 301. Corresponding to the fixed contact point terminals disposed at rear portions of the respective color developing devices, four PCB output terminals 317*a* are disposed on the PCB 301.

As shown in FIG. 8, a lower portion of the PCB 301 is provided with openings 302*a*, 302*b*, 302*c*, and 302*d* spaced apart from the PCB input terminals 303*a*, 303*b*, 303*c* and 303*d* fixed to the upper portion of the PCB 301. Bosses 315*a*, 315*b*, 315*c* and 315*d*, of a frame of the color image forming apparatus, protrude through the openings 21*a*, 21*b*, 21*c* and 21*d*.

The fixed contact point terminal 307*a* formed at the rear portion of the yellow developing device 309*a* is directly connected to the PCB output terminal 317*a* disposed at the lower portion of the PCB 301, but according to the second aspect of the present invention, the fixed contact point terminal 307*a* is connected to a terminal connecting part which is formed as a spring terminal 305*a*. The spring terminal 305*a* has excellent flexibility and thus absorbs the shock that may be transmitted from the PCB 301, thereby blocking the shock from reaching the developing device 309*a*.

There are four voltage changeover units, being formed as a solenoid part 321*a*, to supply high voltages to the respective color developing devices. As shown in FIG. 7, each solenoid part 321*a* includes a holder 319*a*, a contacting member 310*a* connected with the PCB output terminal 317*a*, and a solenoid 15*a* for advancing, and retreating, the holder 319*a* toward and from the PCB 301. The contacting member 310*a* is formed as a plate spring, and connected with one side to the holder 303*a* and fixed with the other side to the PCB 301.

Such a contacting member 311*a* connects the PCB input terminal 303*a* and the pCB output terminal 317*a* with the voltage changeover unit, i.e., with the solenoid part 321*a*. The connecting member may be made of any material allowing a high voltage to flow therein. According to the second aspect of the present invention, a plate spring having excellent flexibility is used.

As shown in FIG. 7, an upper portion of the contacting member 310*a* connected to the holder 319*a* branches into two parts, which is a hook-shaped ring 311*a*. The hook-shaped ring 311*a* comes into contact with the PCB input terminal 303*a* of the PCB 301 with the holder 319*a* being advanced and retreated by the solenoid 320*a*, thereby improving a contacting force.

Also, a lower portion of the contacting member 310*a* is fastened to the PCB 301 via the boss 315*a* of the frame of the color image forming apparatus. The number of contacting member 310*a* provided is the same as the number of the respective contacting terminals as shown in FIG. 8.

The solenoid 320*a* is an example of a holder-moving unit for moving the holder 319*a*, and other various embodiments in addition to the solenoid 320*a* are possible. The reference numeral 36 of FIG. 7 indicates a bracket for supporting the solenoid 320*a*.

The operation of the voltage supply device for the developing device of the color image forming apparatus according to the second aspect of the present invention will be described in greater detail with reference to FIGS. 7 and 9. For the convenience in explanation, the operation of the voltage supply device of one representative developing device will be described. However, it should be noted that the operation of the other voltage supply devices are same.

FIG. 7 shows a state where power is not supplied to the solenoid 320*a*, i.e., a high voltage is not supplied to the developing device 309*a*.

As shown in FIG. 7, the contacting member 310*a* is in a retreating state from the PCB 301. Accordingly, high voltage is not supplied to the developing device 309*a* so that the developing device 309*a* is in a non-developing condition and one of the other developing devices is in a developing condition. That is, the developing devices except the one developing device that is in the developing condition are not supplied with high voltage, as shown in FIG. 7.

When one developing device in the non-developing condition is switched to a developing condition, power is supplied to the solenoid 320*a* so that the holder 319*a* moves toward the PCB 301. Accordingly, the hook-shaped ring 311*a*, at the upper portion of the contacting member 310*a* connected to the holder 319*a*, comes into contact with the PCB input terminal 303*a* of the PCB 301.

The arrows 327 of FIG. 9 represent a flow path of high voltage that is supplied when the hook-shaped ring 311*a* at the upper portion of the contacting member 310*a* comes into contact with the PCB input terminal 303*a* of the PCB 301 and a power supply to the solenoid 320*a*. That is, the high voltage is transmitted from the PCB input terminal 303*a* of the PCB 301 to the contacting member 310*a*, and then, the high voltage passes through the PCB output terminal 317*a*, and is supplied to the developing device 28*a* through the terminal connecting part 305*a* and the fixed contact point terminal 307*a*.

The following brief descriptions describe a method of providing high voltage according to second aspect of the present invention. The descriptions include references to an apparatus, such as illustrated in FIGS. 7-9, for sake of illustration, but is not limited to such:

1. Supplying power to a solenoid 320*a;*
2. Contacting the hook-shaped ring 311*a* at the upper portion of the contacting member 310*a* with the PCB input terminal 303*a* of the PCB 301;
3. Supplying a high voltage as generated;
4. Completing a developing operation of a corresponding developing device;
5. Interrupting the high voltage;
6. Interrupting the power to the solenoid 320*a;*
7. Retreating the hook-shaped ring 311*a* at the upper portion of the contacting member 310*a* from the PCB input terminal 303*a* of the PCB 301; and
8. Supplying power to a solenoid of another developing device, for example to a solenoid 320*b*.

The developing processes 1 to 7 are repeated with respect to the respective color developing devices, one after another, thereby developing a color image.

By repeating the above-described processes, an electrostatic latent image formed on the photosensitive medium is developed into a visible image. Since the high voltage is supplied in order to the color developing devices with the respective color developing devices being fixed, the image quality deterioration problem that is caused by the conventional developing device moving method can be solved.

Although a few embodiments of the present invention have been shown and described, it would be appreciated by those skilled in the art that changes may be made in these embodiments without departing from the principles and spirit of the invention, the scope of which is defined in the claims and their equivalents.

That is, the high voltage changeover device, and method of the present invention can be applied to various printers, photocopiers and multi-function machines, in addition to the color laser printer, which require a sequential control of the developing device voltage supply.

What is claimed is:

1. A voltage supply device for developing devices of a color image forming apparatus, the voltage supply device comprising:

a printed circuit board (PCB) connected with a high voltage supply source;

a plurality of PCB input terminals and a plurality of PCB output terminals provided at the PCB;

a plurality of fixed contact point terminals provided to one end of the color developing devices;

a plurality of terminal connecting parts connecting the PCB output terminals and the fixed contact point terminals; and a plurality of voltage changeover units comprised of a relay part which selectively applies voltage to the PCB output terminals to selectively supply the voltage from the high voltage supply source to the respective color developing devices, wherein the voltage changeover units are located at an opposite side to the color developing devices with reference to the printed circuit board (PCB), and the relay part comprises:

a supporting member provided at the PCB;

an electromagnet fixed to the supporting member and magnetized by an electric current;

an armature pivotally movable so as to pivot with respect to the supporting member to contact with or spaced apart from the electromagnet according to a magnetic force of the electromagnet during the operation of the electromagnet; and at least a pair of relay input terminal and relay output terminal arranged on a voltage supply path of the PCB, in an opposite position with each other at a predetermined distance, the relay input terminal and the relay output terminal being contacted with, or spaced apart from each other according to contact and non-contact of the armature with the electromagnet so as to switch the power supply accordingly.

2. The voltage supply device of claim 1, wherein the armature is formed as a metal plate member in letter 'L' shape, which comprises a first end for being contacted with, or spaced apart from the electromagnet by the magnetic force of the electromagnet during the operation of the electromagnet, and a second end for contacting the relay input terminal with the relay output terminal when the first end contacts with the electromagnet.

3. The voltage supply device of claim 2, wherein the armature further comprises an extendibly-moving member which is arranged between one among the relay input terminal and the relay output terminal on the one hand, and the second end of the armature on the other hand, to move with respect to the supporting member and assist the second end to connect the relay input terminal and the relay output terminal when the first end contacts with the electromagnet.

4. The voltage supply device of claim 3, wherein the extendibly-moving member comprises a non-conductive plate member in the shape of letter 'T' which is secured with a lower end to one among the relay input terminal and the relay output terminal through a receiving hole defined in the supporting member.

5. The voltage supply device of claim 4, wherein the relay input terminal and the relay output terminal each comprises a plate spring having a conductivity and is secured to the PCB through the supporting member, and a contact point formed at an end of the plate spring.

6. The voltage supply device of claim 5, wherein the terminal connecting part comprises a spring to absorb shock.

7. The voltage supply device of claim 1, wherein at least one of the terminal connecting parts, which corresponds to the developing devices, supply power to a plurality of different elements of the developing devices.

8. A voltage supply device for developing devices of a color image forming apparatus, the voltage supply device comprising:

a printed circuit board (PCB) connected with a high voltage supply source;

a plurality of PCB input terminals and a plurality of PCB output terminals provided at the PCB;

a plurality of fixed contact point terminals provided to one end of the color developing devices;

a plurality of terminal connecting parts connecting the PCB output terminals and the fixed contact point terminals; and a plurality of voltage changeover units comprised of a solenoid part which selectively applies voltage to the PCB output terminals to selectively supply the voltage from the high voltage supply source to the respective color developing devices, wherein the voltage changeover unit comprises a holder, a contacting member having one side connected to the holder and the other side fixed to the PCB output terminals, and a holder-moving unit for moving the holder toward and away from the PCB.

9. The voltage supply device of claim 8, wherein an upper portion of the contacting member being connected with the holder is formed into a hook-shaped ring, and a lower portion is fixed to the PCB.

10. The voltage supply device of claim 8, wherein the contacting member is a plate spring to absorb shock.

* * * * *